US011162708B2

(12) United States Patent
Marco et al.

(10) Patent No.: US 11,162,708 B2
(45) Date of Patent: Nov. 2, 2021

(54) APPARATUS FOR RAPID HEATING OF LIQUIDS

(71) Applicant: GENIE ENTERPRISE LTD., Rishpon (IL)

(72) Inventors: Doron Bernard Marco, Tel Aviv (IL); Ayelet Carasso, Tel Aviv (IL)

(73) Assignee: Genie Enterprise Ltd., Rishpon (IL)

( * ) Notice: Subject to any disclaimer, the term of this patent is extended or adjusted under 35 U.S.C. 154(b) by 1080 days.

(21) Appl. No.: 14/942,149

(22) Filed: Nov. 16, 2015

(65) Prior Publication Data

US 2017/0138632 A1 May 18, 2017

(51) Int. Cl.

| | |
|---|---|
| ***F24H 1/10*** | (2006.01) |
| ***F24H 1/14*** | (2006.01) |
| ***F24D 19/00*** | (2006.01) |
| ***F28F 1/40*** | (2006.01) |
| ***F24H 9/00*** | (2006.01) |
| ***F28F 19/00*** | (2006.01) |

(52) U.S. Cl.
CPC ..... *F24H 1/101* (2013.01); *F24D 19/0092* (2013.01); *F24H 1/142* (2013.01); *F24H 9/0015* (2013.01); *F28F 1/405* (2013.01); *F28F 19/00* (2013.01)

(58) Field of Classification Search
CPC ... F24H 1/101; F24H 1/00; F24H 1/10; F24H 1/102; F24H 1/103; F24H 1/105; F24H 1/106; F24H 1/107; F24H 1/12; F24H 1/121; F24H 1/122; F24H 1/125; F24H 1/128; F24H 1/14; F24H 1/142; F24H 1/145; F24H 1/16
USPC ..... 392/471–473, 476–483, 486–493, 392/495–503
See application file for complete search history.

(56) References Cited

U.S. PATENT DOCUMENTS 3,934,117 A * 1/1976 Schladitz ..... F24H 1/105 392/488
4,310,747 A 1/1982 Rice et al.
4,818,842 A 4/1989 Walty
(Continued)

FOREIGN PATENT DOCUMENTS

FR 2713871 A1 6/1995
GB 347650 A 4/1931
(Continued)

OTHER PUBLICATIONS

An International Search Report and a Written Opinion both dated Mar. 2, 2017, which issued during the prosecution of Applicant's PCT/IL2016/051190.
(Continued)

*Primary Examiner* — Tu B Hoang
*Assistant Examiner* — Diallo I Duniver
(74) *Attorney, Agent, or Firm* — Sughrue Mion, PLLC

(57) ABSTRACT

Apparatus for rapid heating of a liquid including a heat source, a liquid flowpath defining element defining a liquid heating flowpath therein having a liquid inlet and a liquid outlet, a collection of flexible elongate thermal conductors located within the flowpath, the collection of flexible elongate thermal conductor portions being thermally coupled to the heat source and defining multiple liquid heating passageways through the flowpath whose configurations and cross-sectional dimensions change over time, thereby being resistant to clogging.

4 Claims, 4 Drawing Sheets

(56) References Cited

U.S. PATENT DOCUMENTS

| | | | | |
|---|---|---|---|---|
| 5,958,273 | A * | 9/1999 | Koch | B01J 8/0285 219/651 |
| 6,008,482 | A * | 12/1999 | Takahashi | B24B 49/105 219/601 |
| 7,971,862 | B2 * | 7/2011 | Kanda | F22B 1/28 261/128 |
| 2003/0041745 | A1 | 3/2003 | Laflamme | |
| 2005/0284864 | A1 | 12/2005 | Yamada | |
| 2011/0117259 | A1 | 5/2011 | Storek et al. | |
| 2011/0244108 | A1 | 10/2011 | Rabin | |
| 2014/0076167 | A1 | 3/2014 | Boggavarapu | |
| 2015/0079237 | A1 | 3/2015 | Gamay et al. | |
| 2015/0230657 | A1 | 8/2015 | Marco et al. | |
| 2016/0058065 | A1 | 3/2016 | Mantry et al. | |
| 2016/0288990 | A1 | 10/2016 | Roberts et al. | |

FOREIGN PATENT DOCUMENTS

| | | | |
|---|---|---|---|
| JP | 63-17392 | A | 1/1988 |
| JP | 3078015 | U | 6/2001 |
| JP | 2002-130975 | A | 5/2002 |
| JP | 2007-46812 | A | 2/2007 |
| WO | 0194006 | A2 | 12/2001 |

OTHER PUBLICATIONS

An Invitation to pay additional fees dated May 24, 2017, which issued during the prosecution of Applicant's PCT/IL2017/050195.

An International Search Report and a Written Opinion both dated Jul. 31, 2017, which issued during the prosecution of Applicant's PCT/IL2017/050195.

European Search Report dated May 3, 2019 which issued during the prosecution of Applicant's European App No. 16865874.8.

An English translation of an Office Action dated Sep. 1, 2020, which issued during the prosecution of Japanese Patent Application No. 544446/2018.

An Office Action dated Nov. 4, 2020, which issued during the prosecution of Chinese Patent Application No. 201680066945.0.

* cited by examiner

APPARATUS FOR RAPID HEATING OF LIQUIDS

FIELD OF THE INVENTION

The present invention relates generally to heating of liquids and more particularly to devices for rapid heating of water.

BACKGROUND OF THE INVENTION

Various types of devices for heating of liquids are known.

SUMMARY OF THE INVENTION

The present invention seeks to provide an improved device for heating of liquids. There is thus provided in accordance with a preferred embodiment of the present invention apparatus for rapid heating of a liquid including a heat source, a liquid flowpath defining element defining a liquid heating flowpath therein having a liquid inlet and a liquid outlet, a collection of flexible elongate thermal conductors located within the flowpath, the collection of flexible elongate thermal conductor portions being thermally coupled to the heat source and defining multiple liquid heating passageways through the flowpath whose configurations and cross-sectional dimensions change over time, thereby being resistant to clogging.

Preferably, the collection of flexible elongate thermal conductors is fixed to the liquid flowpath defining element. Additionally or alternatively, the collection of flexible elongate thermal conductors includes multiple separate conductors mutually arranged in an irregular and mutually displaceable arrangement, which changes in response to liquid flow therepast. Additionally or alternatively, the liquid flowpath defining element is a thermal conductor and is coupled to the heat source and the multiplicity of flexible elongate thermal conductors.

In accordance with a preferred embodiment of the present invention the liquid flowpath defining element includes a bore defining the liquid flowpath and a recess, spaced from the bore, for receiving the heating element. Additionally, the collection of flexible elongate thermal connectors is packed within the bore and in thermal contact with the heating element via the liquid flowpath defining element.

In accordance with a preferred embodiment of the present invention the collection of flexible elongate thermal connectors has a dynamic arrangement of interstices in response to liquid flow therepast.

There is also provided in accordance with another preferred embodiment of the present invention a method for rapid heating of a liquid including directing liquid along a liquid heating flowpath in which are located a collection of flexible thermal conductors which define interstices therebetween and conducting heat from a heat source to the liquid via the flexible thermal conductors.

In accordance with a preferred embodiment of the present invention the liquid heating flowpath is defined by a liquid flowpath defining element having a liquid inlet and a liquid outlet and the collection of flexible elongate thermal conductors located within the flowpath defines multiple liquid heating passageways through the flowpath whose configurations and cross-sectional dimensions change over time, thereby being resistant to clogging. Additionally, the collection flexible elongate thermal conductors includes multiple separate conductors mutually arranged in an irregular and mutually displaceable arrangement, which changes in response to liquid flow therepast.

Preferably, the liquid flowpath defining element operates as a thermal conductor and transmits heat from the heat source to the flexible elongate thermal conductors. Additionally or alternatively, the liquid flowpath defining element is a thermal conductor and is coupled to the heat source and the multiplicity of flexible elongate thermal conductors.

In accordance with a preferred embodiment of the present invention the collection of flexible elongate thermal conductors includes multiple separate conductors mutually arranged in an irregular and mutually displaceable arrangement, which changes in response to liquid flow therepast. Preferably, the liquid flowpath defining element transmits heat from heat source to the flexible elongate thermal conductors.

BRIEF DESCRIPTION OF THE DRAWINGS

The present invention will be understood and appreciated more fully from the following detailed description, taken in conjunction with the drawings, in which.

DETAILED DESCRIPTION OF A PREFERRED EMBODIMENT

Figure 1A:
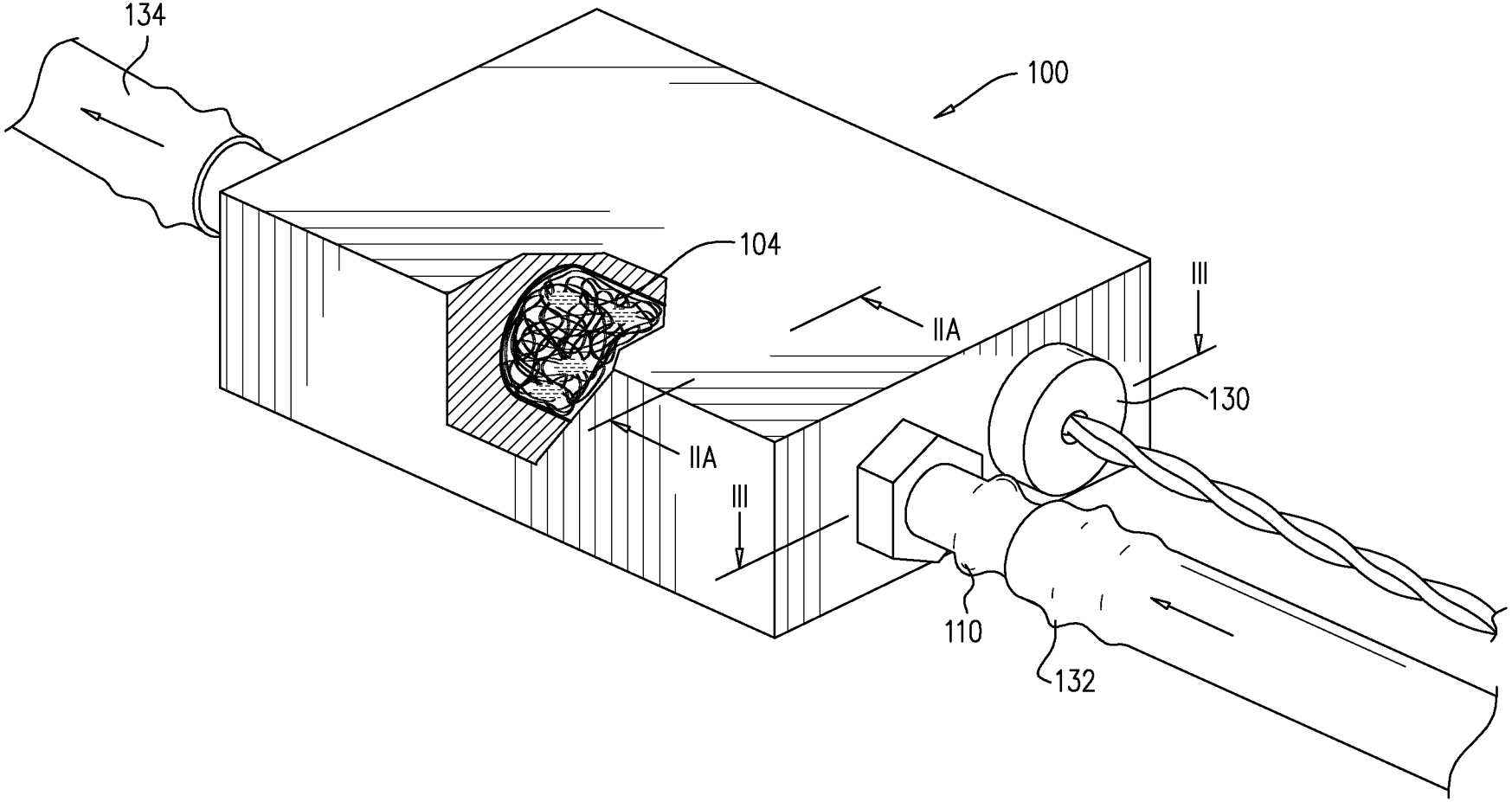
FIGS. 1A & 1B are a simplified assembled view illustration and a simplified exploded view illustration, respectively, of apparatus for rapid heating of liquids, constructed and operative in accordance with a preferred embodiment of the present invention.
Figure 1B:
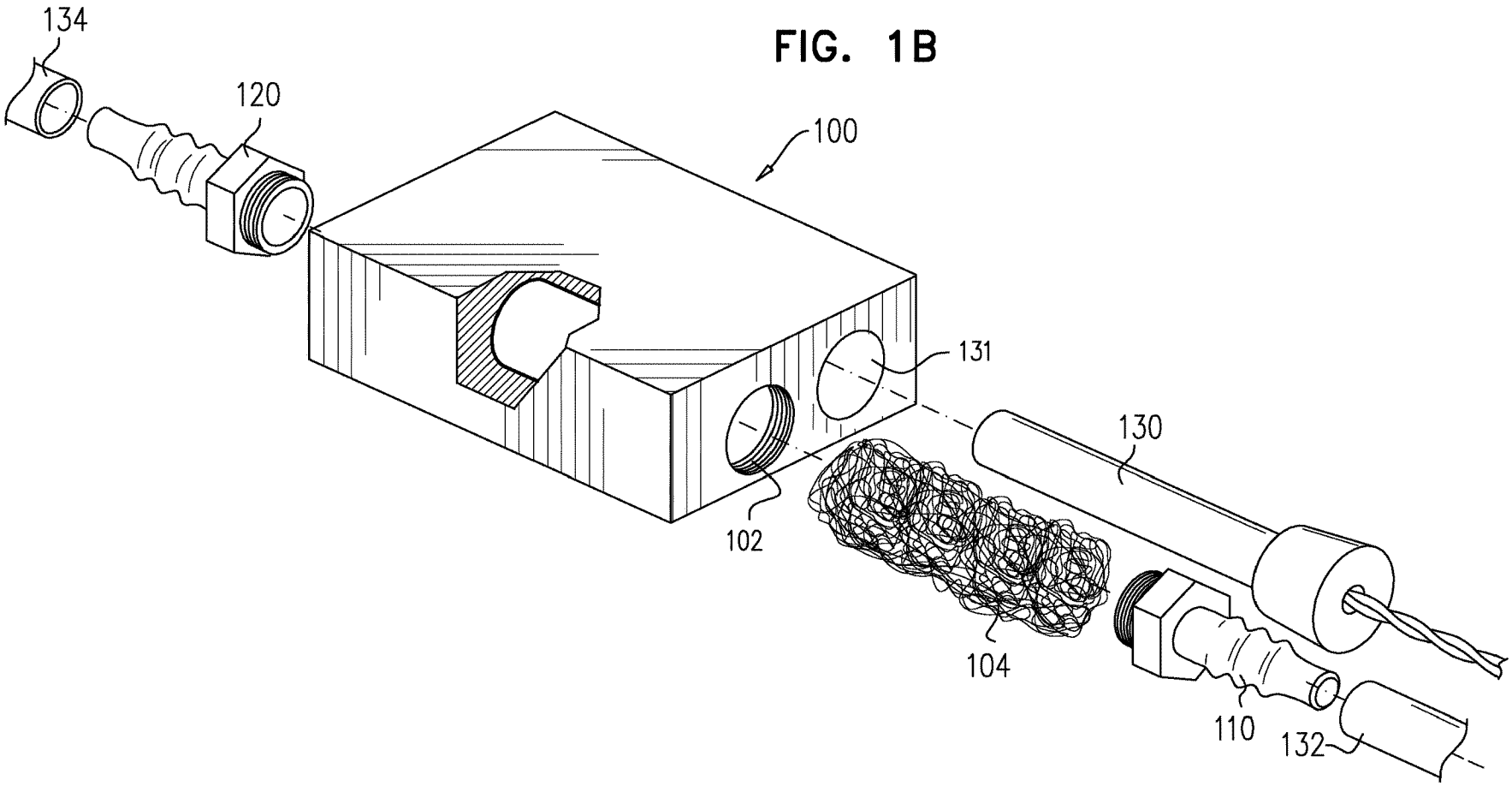
Figure 2A:
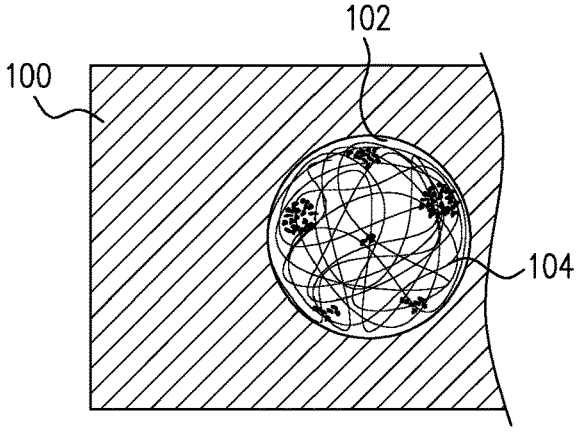
FIGS. 2A, 2B, 2C and 2D are simplified sectional illustrations of a liquid heating pathway, taken along lines IIA-IIA in FIG. 1A at four different points in time and showing variability in the configuration thereof.
Figure 2B:
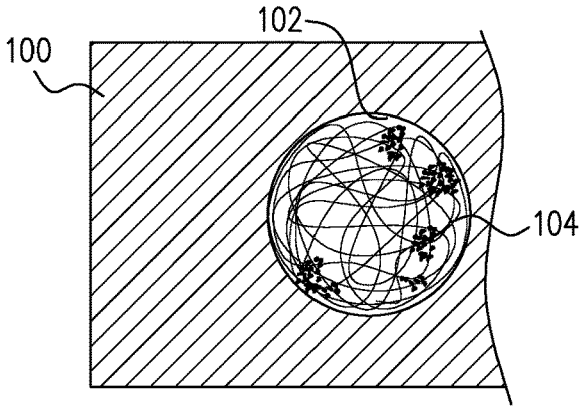
Figure 2C:
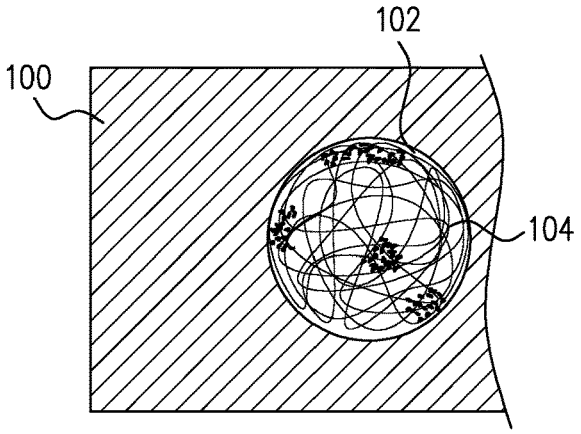
Figure 2D:
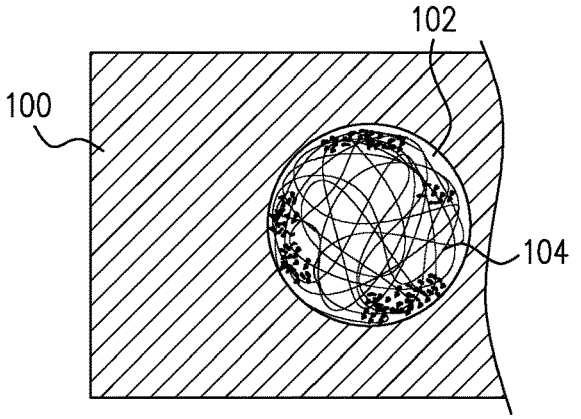
Figure 3:
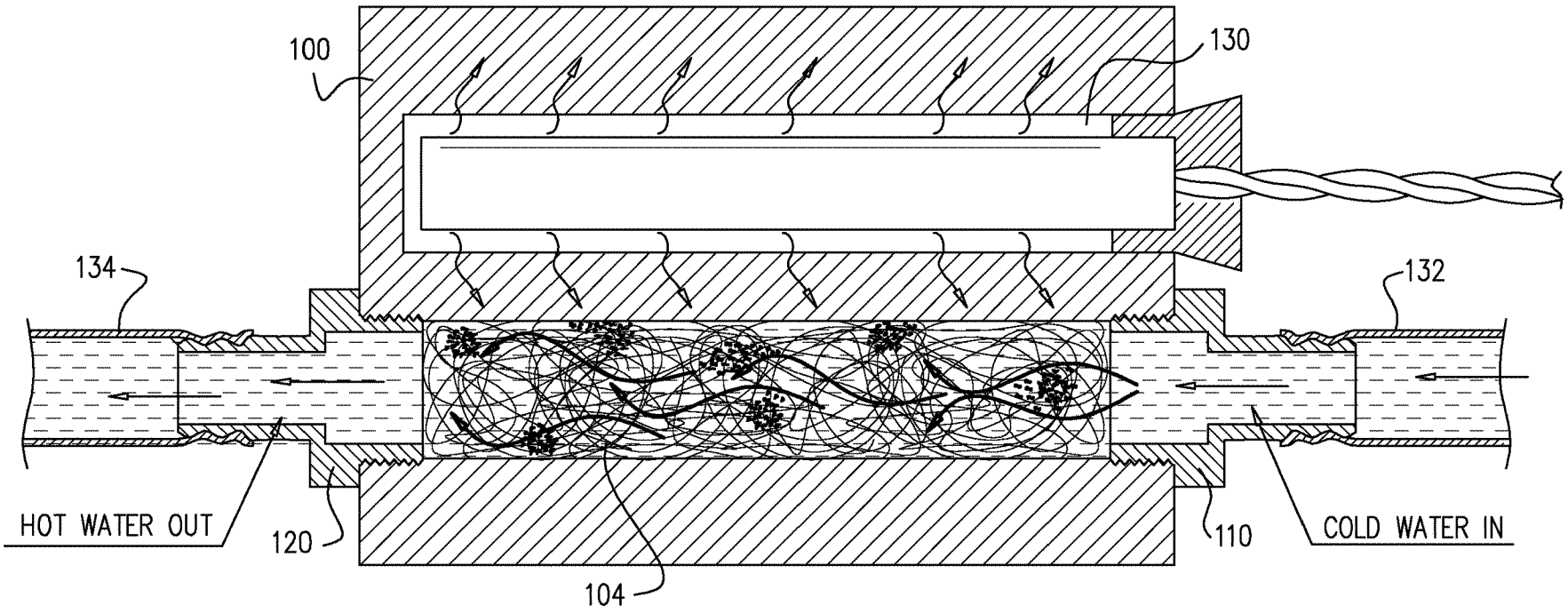
FIG. 3 is a simplified illustration of the apparatus for rapid heating of liquids, taken along lines III-III in FIG. 1A.

Reference is now made to FIGS. 1A-3, which illustrate apparatus for rapid heating of liquids, constructed and operative in accordance with a preferred embodiment of the present invention. As seen in FIGS. 1A-3, the apparatus comprises a heat conducting and liquid conveying element 100, preferably formed of a highly heat conductive metal, such as aluminum, and including a liquid flow and heating bore 102, extending therethrough, in which are located a collection 104 of mutually displaceable thermal conductors, typically formed of stainless steel, which are preferably intertwined in a manner which changes over time in response to liquid flow therepast. The collection 104 may be defined by multiple separate conductors or alternatively by a single conductor. The thermal conductors are typically in the form of narrow strips or fibers.

Liquid inflow and outflow fixtures 110 and 120 are typically formed of aluminum or another suitable heat-conducting metal and coupled to respective inflow and outflow ends of bore 102. A heating element 130 is located in a heating element recess 131 formed in element 100. An example of a suitable heating element 130 is an electromagnetic heating element manufactured by Shenzhen Hanke Instrument Co., Ltd, headquartered at #2 Shangxue City 1st Road, Bantian, Longgang District, P.C. Heating element 130 preferably reaches a peak temperature of approximately 180° Celsius.

Inlet and outlet liquid conduits 132 and 134, typically formed of metal, rubber or plastic, are attached, respectively, to liquid inflow and outflow fixtures 110 and 120 and connect bore 102 to a source of liquid to be heated (not shown) and to a heated liquid utilization device (not shown).

Reference is now made to FIGS. 2A, 2B, 2C, 2D which illustrate a particular feature of an embodiment of the present invention wherein, as the result of liquid flow thereby the arrangement of the thermal conductors in collection 104 changes over time, preferably in a random or unpredictable manner, preferably such that the interstices therebetween change in configuration over time in a random or unpredictable manner. This has a particular advantage in that clogging of the collection 104 by solid or semisolid impurities in the liquid flowing through bore 102 is largely obviated.

In this way, as can be seen by comparing FIGS. 2A, 2B, 2C and 2D, clogging of a given region between adjacent thermal conductors leads to mutual displacement of the thermal conductors defining that region, thereby changing the configuration of the interstices and allowing the impurities to pass. This is in distinction to a fixed mesh in which the configuration of the interstices between adjacent conductors is fixed, often leading to incremental clogging of the entire mesh.

In a preferred embodiment, the collection 104 of thermal conductors is lightly packed into bore 102 in good thermal contact with element 100 such that heat produced by heating element 130 is efficiently conducted via element 100 to the thermal conductors in collection 104 and to the liquid flowing therepast in bore 102. The conductors in collection 104 may or may not be fixed to element 100. Preferably, the flow of water through bore 102 past the collection 104 of thermal conductors is turbulent flow and this turbulent flow enhances the mutual displacement of the conductors and the realignment of the interstices thereof over time.

It will be appreciated by persons skilled in the art that the present invention is not limited by what has been particularly shown and described hereinabove. Rather the scope of the present invention includes both combinations and subcombinations of features described hereinabove and variations and modifications thereof which are not in the prior art.

The invention claimed is:

1. Apparatus for rapid heating of a liquid comprising:

a heating element;

a liquid flowpath defining element including a bore, said bore defining a liquid flowpath therein having a liquid inlet and a liquid outlet, said liquid flowpath defining element also defining a heating element recess separate from and spaced from said bore, said heating element generally filling said heating element recess, said heating element being thermally coupled to said liquid flowpath defining element; and a collection of flexible elongate thermal conductors in the form of the intertwined fibers having multiple liquid heating passageways located within said liquid flowpath, said collection of flexible elongate thermal conductors being fixed to said liquid flowpath defining element, said collection of flexible elongate thermal conductors being thermally coupled to said heating element via said liquid flowpath defining element and the liquid flowpath of the bore defining multiple liquid heating passageways between the fibers of the collection of the thermal conductors is a turbulent flowpath that enhances the mutual displacement of the flexible elongate thermal conductors and the realignment of the multiple liquid heating passageways, between the fibers of the collection of the thermal conductors, whose configurations and cross-sectional dimensions change over time, thereby being resistant to clogging, said liquid flowpath defining element being configured to operate as a thermal conductor and to transmit heat from said heating element to said collection of flexible elongate thermal conductors.

2. Apparatus for rapid heating of a liquid according to claim 1 wherein said collection of flexible elongate thermal conductors comprises multiple separate conductors mutually arranged in an irregular and mutually displaceable arrangement, which changes in response to liquid flow therepast.

3. Apparatus for rapid heating of a liquid according to claim 1 wherein said collection of flexible elongate thermal conductors is packed within said bore and in thermal contact with said heating element via said liquid flowpath defining element.

4. Apparatus for rapid heating of a liquid according to claim 3 wherein said collection of flexible elongate thermal conductors has a dynamic arrangement of interstices in response to liquid flow therepast.

* * * * *